US012735880B2

(12) United States Patent
Amzallag

(10) Patent No.: US 12,735,880 B2
(45) Date of Patent: Sep. 15, 2026

(54) SYSTEM FOR TREATING AND PREVENTING BLOCKAGE AND/OR AIRLOCKS IN SANITATION FIXTURES

(71) Applicant: Avraham Amzallag, Tel Aviv (IL)

(72) Inventor: Avraham Amzallag, Tel Aviv (IL)

( * ) Notice: Subject to any disclaimer, the term of this patent is extended or adjusted under 35 U.S.C. 154(b) by 102 days.

(21) Appl. No.: 18/793,973

(22) Filed: Aug. 5, 2024

(65) Prior Publication Data

US 2025/0137243 A1 May 1, 2025

Related U.S. Application Data

(60) Provisional application No. 63/545,569, filed on Oct. 25, 2023.

(51) Int. Cl.
*E03C 1/30* (2006.01)

(52) U.S. Cl.
CPC ..... *E03C 1/30* (2013.01)

(58) Field of Classification Search
CPC ..... E03C 1/266; E03C 1/2665; E03C 1/30; E03C 1/302; B08B 9/027; E03F 9/002; Y10T 137/4351; Y10T 137/4343; Y10T 137/4336; Y10T 137/2802; Y10T 137/2815; Y10T 137/2829
USPC ..... 137/136, 140
See application file for complete search history.

(56) References Cited

U.S. PATENT DOCUMENTS 232,376 A * 9/1880 Staples ..... F16K 3/0281 4/679
1,732,775 A * 10/1929 Shaver ..... E03C 1/2665 241/46.06
2,610,696 A * 9/1952 Mayberry ..... E03C 1/302 15/104.095
3,303,789 A * 2/1967 Geisinger ..... E03C 1/266 4/679
7,107,634 B1 * 9/2006 Baird ..... E03C 1/28 4/256.1
10,364,558 B2 * 7/2019 Swadesh ..... E03C 1/29

* cited by examiner

*Primary Examiner* — Erin Deery

(57) ABSTRACT

A system and method for preventing and treating blockage and/or airlock of a sanitation fixture. The system and method may include a cleaning head that is moved manually to break up a blockage in a trap and/or a drain tube. The system and method may include a venting air from an airlock from a vent in a siphon above the bottom of a connection between the siphon and a drain pipe to the drain tube above the vent.

12 Claims, 17 Drawing Sheets

SYSTEM FOR TREATING AND PREVENTING BLOCKAGE AND/OR AIRLOCKS IN SANITATION FIXTURES

RELATED APPLICATIONS

This application claims the benefit of priority under 35 USC § 119(e) of U.S. Provisional Patent Application No. 63/545,569 filed 25 Oct. 2023, the contents of which are incorporated herein by reference in their entirety.

FIELD AND BACKGROUND OF THE INVENTION

The present invention, in some embodiments thereof, relates to a system for treating and/or preventing blockage and/or airlocks in sanitation fixtures, and, more particularly, but not exclusively, drainage systems.

An airlock is a pocket of air that gets trapped inside a drain line. This can be caused by a blocked drain pipe. For example, when a drain pipe gets blocked past the trap, the trap prevents release of air from the pipe. This can prevent the water in the trap from rising and stopping water flow from the sink into the drain pipe. Therefore, the pipe stays dry, and water cannot get into the pipe to clear the blockage.

Airlock is a severe plumbing issue because it can constrict the flow of water inside the pipes, leading to sewage backups, potential pipe damage and can cause other plumbing problems and long-term damage. Further, trapped air can cause the drainage lines to be noisy. The noise can be loud and annoying, particularly at night.

Additionally, airlock can also occur inside sump pumps. If this happens, it can cause a lot of issues since the airlock will limit the pump's ability to remove water from the basement or foundation if a flood occurs.

Airlocks in drain lines can sometimes be cleared manually, but the process can be damaging if performed incorrectly. An airlock in a sump pump or drain line can often be resolved by creating a relief hole inside the discharge hole or drain line. However, such relief holes can lead to leakage and the presence of bad odors.

Furthermore, drainage pipes can become clogged and odiferous, being difficult to clean past the trap. Often downstream access ports are not conveniently located for relief of blockages or airlocks.

Accumulation of material in the trap is another source of blockage and foul odors. At the moment, the only way to clear such material is to open the trap and remove the material and the water from the trap.

Therefore, there is a need for a system for treating and preventing blockage and/or airlocks in sanitation fixtures and/or cleaning drainage pipes.

SUMMARY OF THE INVENTION

According to an aspect of some embodiments of the invention, there is provided a system for breaking up a blockage in a sanitation system the sanitation system including a drain tube connected to a drain pipe via a trap cup including: a cleaning head located in a trap cup; the cleaning head including an external blade inside the trap cup, a handle projecting out from the sanitation system configured for manually rotating the cleaning head, thereby moving the external blade inside the trap up preventing or breaking up blockage of the trap cup.

According to some embodiments of the invention, the system further includes: an internal blade inside the drain tube, and wherein rotating the cleaning head, thereby moves the internal blade inside the drain tube preventing or breaking up blockage of the drain tube.

According to some embodiments of the invention, the system further includes a rotating tube concentric to the drain tube and wherein the handle is connected to the rotating tube.

According to some embodiments of the invention, a base of the rotating tube is mounted to the cleaning head.

According to some embodiments of the invention, the of manually rotating is includes rotating the rotating tube.

According to some embodiments of the invention, the rotating tube is configured to be manually rotated by sliding a handle connected through a port of a sanitation system horizontally and radially with respect to the rotating tube.

According to some embodiments of the invention, the rotating tube includes a bypass configured to facilitate exit of waste water directly from the drain tube to the drain pipe without passing through the trap cup.

According to some embodiments of the invention, the internal blade and external blade are connected or co-molded.

According to an aspect of some embodiments of the invention, there is provided a method for breaking up a blockage in a sanitation system the sanitation system including a drain tube connected to a drain pipe via a trap cup, the method including: manually manipulating a handle accessible from outside the sanitation system rotating a cleaning head as a result of the manually manipulating, wherein the cleaning head includes an external blade located within the trap cup and breaking up of a blockage of the trap cup via the rotating.

According to some embodiments of the invention, the cleaning head includes an internal blade located in the drain tube further including: breaking up of a blockage of the drain tube via the rotating.

According to some embodiments of the invention, the method further includes: rotating a rotating tube concentric to the drain tube as a result of the manually manipulating and wherein the handle is connected to the rotating tube and wherein a base of the rotating tube is mounted to the cleaning head.

According to some embodiments of the invention, the method further includes: wherein the manually manipulating includes sliding the handle horizontally and circumferentially with respect to the rotating tube the handle connected through a port of a sanitation system horizontally and radially with respect to the rotating tube.

According to some embodiments of the invention, the method further includes: opening a bypass configured to facilitate exit of waste water directly from the drain tube to the drain pipe without passing through the trap cup.

According to some embodiments of the invention, the method further includes: opening a bypass configured to facilitate exit of waste water directly from the drain tube to the drain pipe without passing through the trap cup and wherein the opening is a result of the rotating.

According to some embodiments of the invention, the rotating aligns a hole in a rotating tube with a side hole in the drain tube facilitating the opening.

According to some embodiments of the invention, the method further includes washing away the broken-up blockage.

According to an aspect of some embodiments of the invention, there is provided a system for releasing an airlock in a siphon connecting drain tube to a drain pipe via trap including: a vent open to a space in the siphon above a bottom of a connection between the siphon and the drain tube an air release tube connecting the vent to the drain pipe.

According to some embodiments of the invention, the air release tube connects to the drain pipe above the vent.

According to some embodiments of the invention, the system further includes a bleed valve located on the air release tube.

According to some embodiments of the invention, the bleed valve is configured to be operated manually by a user.

According to some embodiments of the invention, the bleed valve is configured to prevent exit of water from the system when closed.

According to some embodiments of the invention, the system further includes an inflatable pipe plug configured to controllably inflate and deflate to block and unblock a drain pipe.

According to some embodiments of the invention, the system further includes a filling tube accessible outside the drain pipe and outside the siphon for inflating the inflatable plug.

According to some embodiments of the invention, the system further includes a cleaning head configured to break up a blockage in the drain pipe upon rotation.

According to some embodiments of the invention, the cleaning head is configured to be rotated manually by rotating a crank handle.

According to an aspect of some embodiments of the invention, there is provided a method for releasing an airlock in sanitation system including a siphon connecting drain tube to a drain pipe via trap, the method including: supplying a vent in a portion of the siphon above a connection to the drain pipe; bleeding air of the airlock through the vent; and passing the air through an air release tube to the drain tube above the vent.

passing said air through an air release tube to the drain tube above the vent.

DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF THE INVENTION

Figure 1:
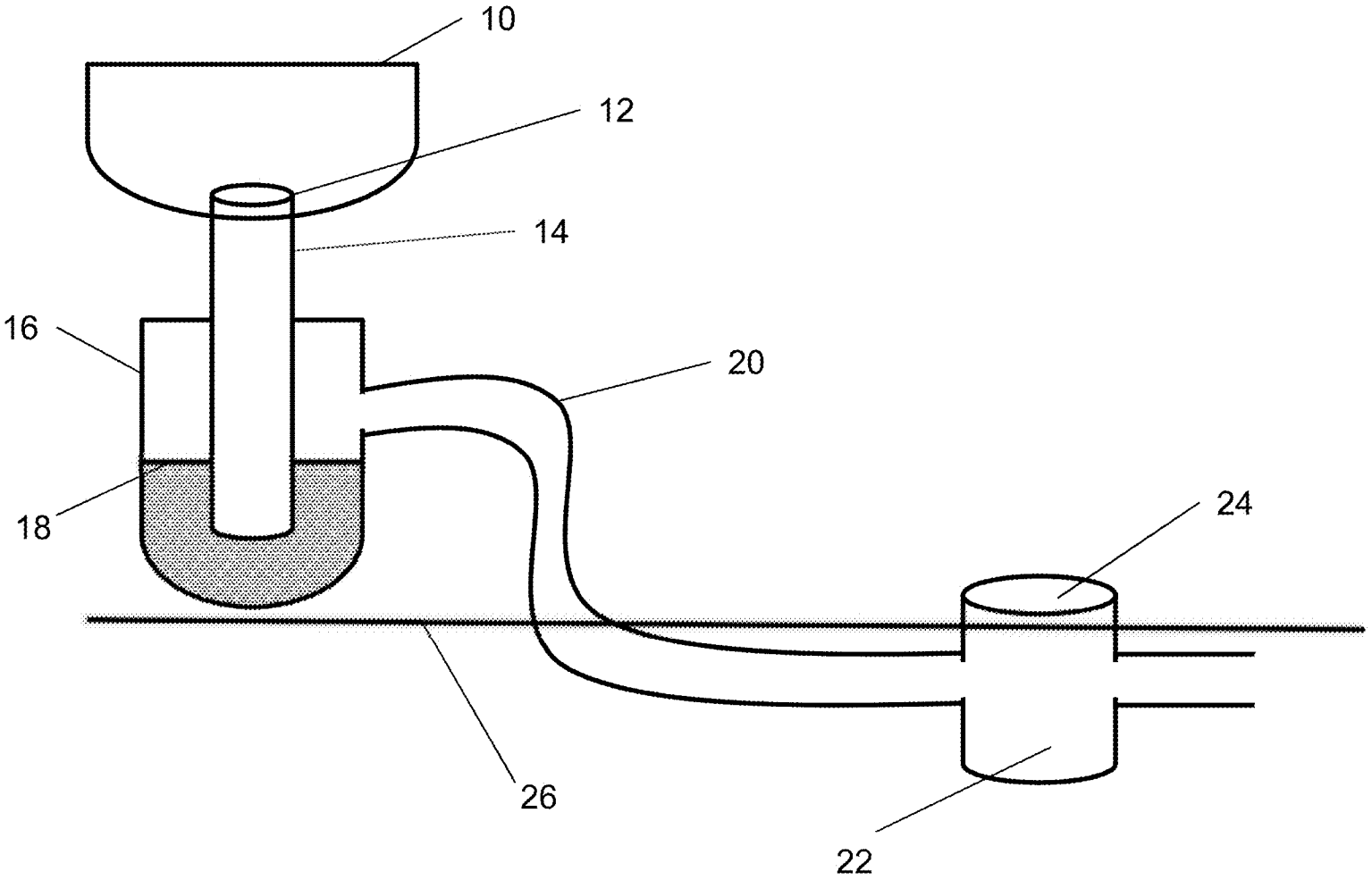
FIG. 1: Schematic illustration of an exemplary drainage system, in accordance with some embodiments of the current invention.

The present invention, in some embodiments thereof, relates to a system for treating and/or preventing airlocks in sanitation fixtures, and, more particularly, but not exclusively, drainage systems.

Overview

Some embodiments relate to a system for treating and/or preventing airlocks in sanitation fixtures. According to some embodiments, the sanitation fixture may be a drainage system, sump, etc. Optionally, the drainage system may provide drainage from a sink, bath, shower, toilet, cooler, industrial plant, swimming pool, ornamental pool, fountain, etc.

According to some embodiments, the system may include an air release vent which may optionally include a valve. Optionally, the air release vent may be located at or near the top of the trap, after the trap, in a vent line, discharge hole, drain line, or any combination thereof.

According to some embodiments, the air release vent may be positioned at or near the top of the trap (e.g., above the outlet pipe). Optionally, a top portion of the trap with the release valve may be sealed e.g., by a sealing ring. Optionally, the air release vent may allow air to pass from below the sealing ring into the drain tube above the sealing ring.

According to some embodiments, the air release vent may be configured to facilitate trapped air bleeding back into the drain tube and/or a drain pipe, e.g., configured to facilitate trapped air bleeding back into a sink drain tube and out the sink drain. In some embodiments, the air release vent may be located above the bottom of the opening between the siphon and the drain pipe. This air in the trap may drain through the vent to the drain tube.

Additionally, and/or alternatively, the system may include an air release tube. Optionally, the air release tube may connect the air release vent to a drain tube. Optionally, the air release tube may allow air from a trap or drain pipe to pass into the drain tube e.g., sink drainage line. Optionally, the drain tube may include a hole to which the air release tube may connect.

According to some embodiments, the air release tube, and/or a portion thereof, may be reversed. According to some embodiments, the air release tube, and/or a portion thereof, may be angled upward from the sink drain and then bending back downward. Optionally, the angle of the air release tube, and/or a portion thereof, may impede water from flowing from the sink drain into the release tube.

Alternatively, or additionally, a bleed valve may be supplied to release trapped air. For example, the bleed valve may be openable and/or closable. For example, the bleed valve may include a gate valve and/or a knob and/or a stopper (e.g., a hole with a screw or stopper (e.g., a plug) therein) to open and/or close the bleed valve.

Advantageously, trapped air may be released from the drainage system through the air release tube and/or air release vent, to prevent and/or treat an airlock.

According to some embodiments, the air release tube may be a bleed tube. According to some embodiments, the bleed tube may be blocked by a one-way valve.

According to some embodiments, the one-way valve may be an air release vent. Optionally, the air release vent may include a pressure release valve (for example, including a ball). For example, the weight of the ball may let air out of the drain tube if there is over pressure, Advantageously, this may prevent venting bad odors from the drain tube when there is no blockage.

According to some embodiments, the system may include an inflatable pipe plug positioned within the drain tube. Optionally, the inflatable pipe plug may be a pipe balloon valve. Optionally, the pipe balloon valve may be configured to be opened and/or closed (e.g., inflated and/or deflated) by a user. Optionally, the pipe balloon valve may be closed, and a cleaning fluid may be poured down the drain tube. Optionally, the cleaning fluid may be bleach, soap, acid, etc., or any combination thereof.

According to some embodiments, the drainage system may be filled with fluid and an airlock may be prevented by air bleeding out of the air bleed valve. Optionally, the cleaning fluid may be allowed to sit in the drain tube a period of time, e.g., several minutes or hours. Optionally, the pipe balloon valve may then be opened, allowing the fluid in the drainage system to empty, thereby cleaning the drainage system. This may advantageously prevent airlocks and/or clogging and/or foul odors.

According to some embodiments, a cleaning head may be included in the trap of a sink siphon. Optionally, the cleaning head may include one or more blades. Optionally, the cleaning head may include one or more external blades (e.g., extending outside of the drain tube and/or cleaning a space (e.g., a trap) outside the drain tube), one or more internal blades (e.g., extending into the drain tube and/or cleaning inside the drain tube), or both. Optionally, the cleaning head and/or the one or more blades may be rotatable. Optionally, the cleaning head may be connected to a rotating tube. Optionally, the cleaning head may be attached to the base of a rotating tube. Optionally, the rotating tube may be located within and/or be connected to the drain tube and/or be concentric to the drain tube. Optionally, the cleaning head may be mounted at an angle to the drain tube, e.g., an angle between 0° to 90° to the drain tube.

According to some embodiments, the blades may be external blades. Optionally, the external blades may project outward, into the trap. Optionally, the external blades may be positioned within the trap. Optionally, the external blades may be rotated within the trap, thereby cleaning the trap. Optionally, the external blades may be external to the drain tube. Optionally, the external blades may be external to the rotating tube. Optionally, the external blades may include one or more fins, e.g., 1, 2, 3, 4, 5, 10, etc. Optionally, the fins may be straight and/or angled and/or curved. For example, straight blades may be parallel to the axis of the drain tube. For example, angled blades may be at an angle of between 5 to 30 degrees and/or between 30 to 60 degrees and/or between 60 to 90 degrees of the axis of the drain tube.

According to some embodiments, the blades may be internal blades. Optionally, the internal blades may project inwards, into the drain tube. Optionally, the internal blades may be positioned within the drain tube and/or rotating tube. Optionally, the internal blades may be rotated within the drain tube and/or rotating tube, thereby cleaning the drain tube. Optionally, the internal blades may include one or more fins, e.g., 1, 2, 3, 4, 5, 10, etc. Optionally, the fins may be straight and/or angled.

According to some embodiments, the cleaning head may include one or more internal blades, one or more external blade, or both, e.g., for cleaning the trap cup, the sink drainage tube, or both.

According to some embodiments, the cleaning head may be rotated automatically, e.g., by the flow of water through the cleaning head. Optionally, flow of water through the cleaning head may rotate the one or more blades. Optionally, automatic rotation of the cleaning head may prevent buildup of material in the drain tube, rotating tube, trap, or any combination thereof. Optionally, automatic rotation of the cleaning head may clean the drain tube, trap, or any combination thereof.

According to some embodiments, the cleaning head may be rotated manually, e.g., by a user. Optionally, a crank handle may be connected to the cleaning head. Optionally, rotation of the crank handle may rotate the cleaning head. For example, the crank handle may project out of the trap e.g., through a port, e.g., from a wall, base, side thereof, etc. or the trap and/or drain tube. Optionally, the port may include a means of preventing exit of water through the port, e.g., a washer, etc. Optionally, manual rotation of the cleaning head may remove buildup of material in the drain tube, trap, or any combination thereof. Optionally, manual rotation of the cleaning head may break up material blocking in the drain tube, trap, or any combination thereof. Optionally, manual rotation of the cleaning head may clean the drain tube, rotating tube, trap, or any combination thereof. Alternatively, or additionally, a handle may be connected to a rotating tube, e.g., to rotate the rotated tube and/or the cleaning head.

According to some embodiments, the sink may include a bypass. Optionally, the upper section of the trap may include a top coupling means for connecting to a drain outlet, a side drain opening with coupling means for connecting to a drain pipe. Optionally, the upper section of the trap may facilitate direct flow through the side drain opening, bypassing a cup of the trap. Optionally, this may facilitate evacuating a substantial volume of accumulated water directly into the drain pipe. Optionally, the upper section of the trap may include a fixed drain tube with at least one first bypass opening facing the side drain opening and a rotatable tube that is concentric with the drain tube. Optionally, the rotating tube may include at least one second bypass opening. Optionally, the bypass may be shifted from a closed bypass state, in which the rotatable tube blocks the second bypass opening, to an open bypass state by rotating the rotatable tube towards the drain tube until the second bypass opening overlaps with the first bypass opening. Optionally, the drain tube may be located within the rotatable tube. Optionally, the rotatable tube may be located within the drain tube and/or around the drain tube. Optionally, rotating the rotating tube may simultaneously open or close the bypass tube and/or move the cleaning head and/or blades.

According to some embodiments, the cleaning head may be mounted to the trap cup. Additionally, or alternatively, the one or more blades may be mounted to the trap cup. Optionally, the one or more blades may be rotatable. Optionally, a trap cup including one or more rotatable blades may replace a standard trap cup.

According to some embodiments, a crank handle may be connected to the cleaning head in the trap cup, e.g., at the bottom of the trap cup. Optionally, the crank handle may project out of the trap cup through a port, e.g., from the side or base. Optionally, the port may include a means of preventing exit of water through the port, e.g., a washer, etc. Optionally, rotation of the crank handle may rotate the one or more blades. Optionally, manual rotation of the cleaning head may remove buildup of material in the trap cup. Optionally, manual rotation of the one or more blades may break up material blocking in the trap cup. Optionally, manual rotation of the cleaning head may clean the trap cup.

According to some embodiments, the one or more blades in the trap cup may be rotated automatically, e.g., by the flow of water through the trap. Optionally, automatic rotation of the one or more blades may prevent buildup of material in the trap cup. Optionally, automatic rotation of the cleaning head may clean the trap.

In an embodiment, all or part of the system may be made from recycled and/or recyclable materials.

In an embodiment, all or part of the system may be recyclable and/or reusable.

Specific Embodiments

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Reference is made to FIG. 1, which is a schematic illustration of an exemplary drainage system, in accordance with an embodiment of the current invention. For example, a sanitation system with normal function in which sink 10 with drain 12 is connected to drain tube 14 leading to trap 16. Trap 16 contains water, with a water level 18 below the level of the exit to drain pipe 20. Drain pipe 20 is connected to a clean out fixture 22 with an optionally sealed access hole 24.

According to some embodiments, all and/or part of the sanitation system may be embedded within floor 26.

Figure 2:
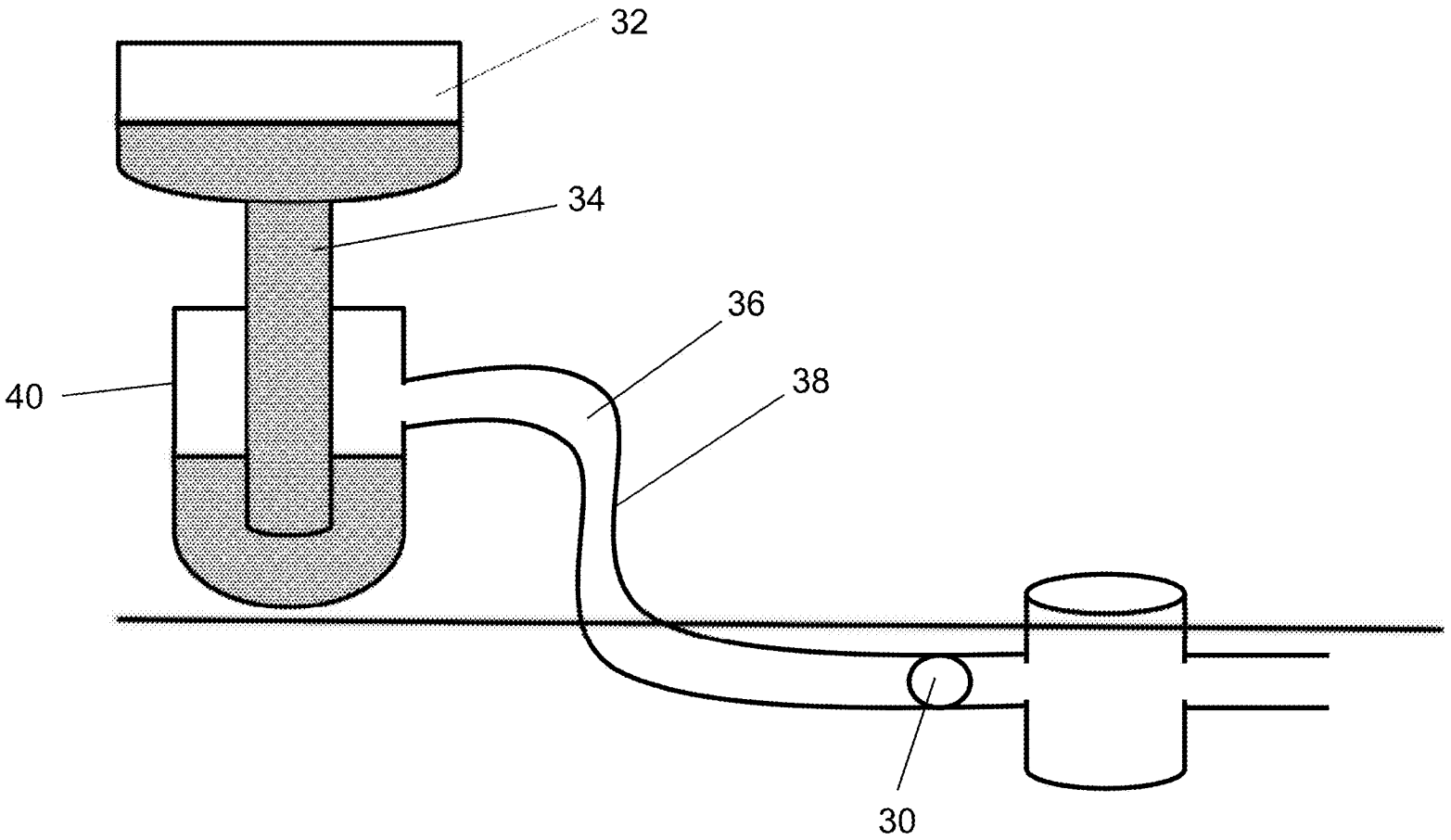
FIG. 2: Schematic illustration of an exemplary drainage system with a blockage, in accordance with some embodiments of the current invention.

Reference is made to FIG. 2, which is a schematic illustration of an exemplary drainage system with a blockage, in accordance with an embodiment of the current invention. For example, in a sanitation system with a blockage 30, sink 32 and drain tube 34 may fill with water. Trapped air 36 in drain pipe 38 cannot escape past blockage 30 on one side and the water in trap 40 on the other side, resulting in an airlock. Since water cannot reach the drain pipe 38, even a small blockage cannot be washed away.

Figure 3:
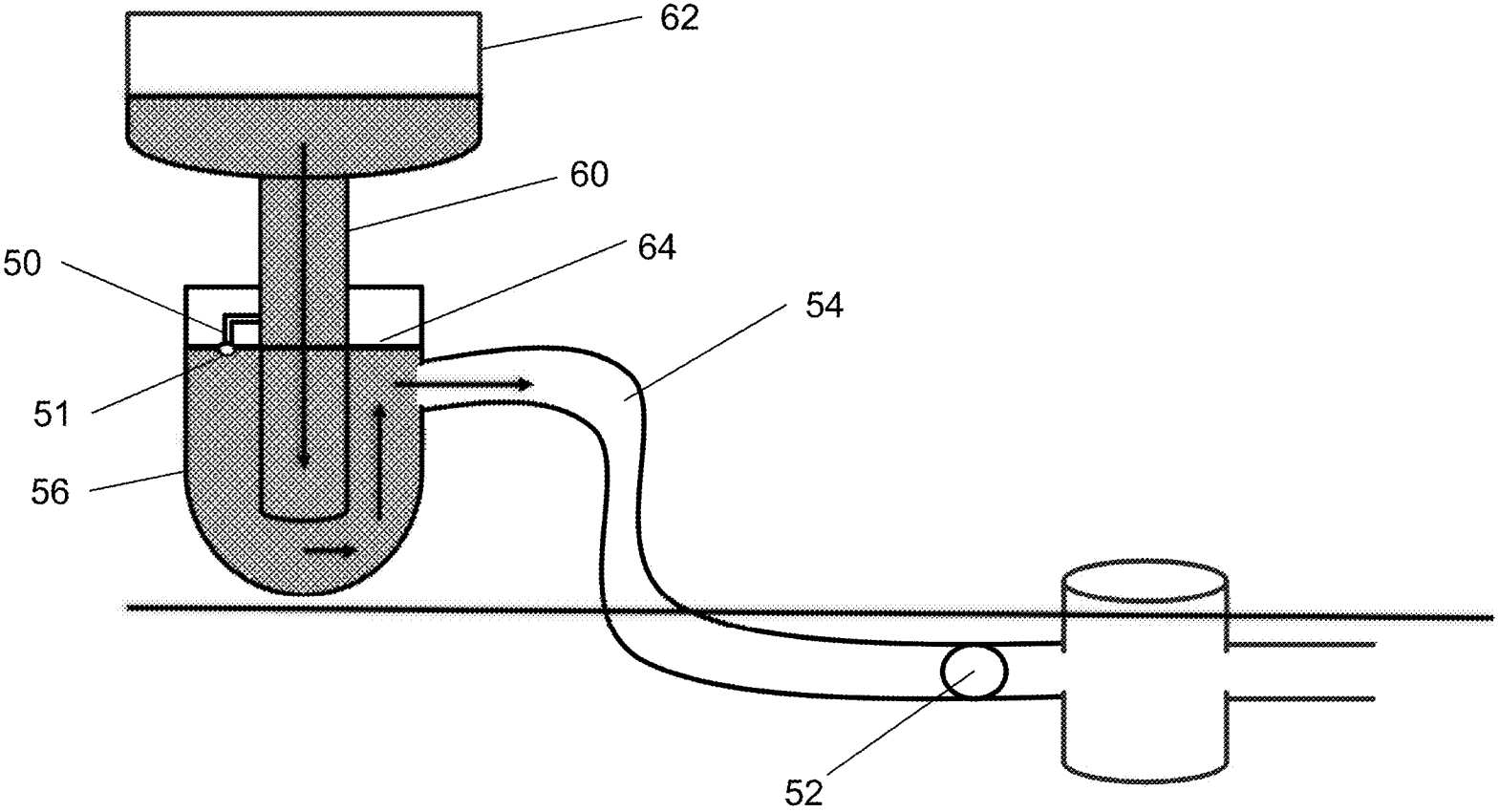
FIG. 3: Schematic illustration of an airlock treatment system, in accordance with some embodiments of the current invention.

Reference is made to FIG. 3, which is a schematic illustration of an airlock treatment system, in accordance with an embodiment of the current invention. For example, in a sanitation system with an air release vent 50 with a blockage 52, air bleed out of air release vent 50 allowing water to reach drain pipe 54 and wash away the blockage 52. Optionally, trap 56 includes sealing ring 64. Optionally, air release vent allows air from below the sealing ring 64 to be released into the drain tube. Air release vent 50 may include a one-way valve and/or a pressure release valve, such that if the air pressure within trap 56 rises, it allows air to bleed off into the drain tube 60, sink 62, drain pipe 54, and to the outside. Water is then freed to flow down drain pipe 54 and to clear the blockage 52. In some embodiments an air release vent 50 may be in the upper part of a trap without a sealing ring. Optionally, the connection between the air release vent 50 to the drain tube 60 is above the opening 51 of the air release vent 50 to the trap.

Figure 4:
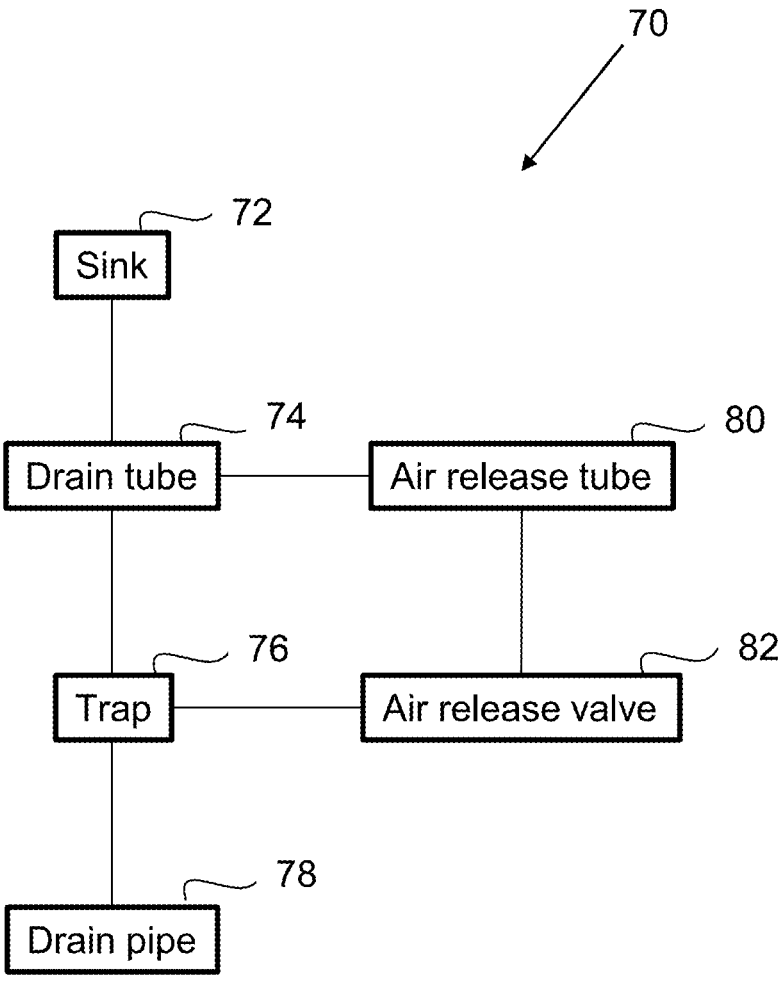
FIG. 4: Block diagram of an airlock treatment system, in accordance with some embodiments of the current invention.

Reference is made to FIG. 4, which is a block diagram of an airlock treatment system, in accordance with an embodiment of the current invention. For example, a drainage system 70 may include sink 72 connected by drain tube 74 to trap 76 connected to drain pipe 78. Trap 76 may optionally include a one-way air release valve 82 connected by air release tube 80 to the drain tube 74. If a blockage occurs in the drain pipe, airlock is prevented by bleeding off the air through the air release valve and air release tube back into the drain tube or sink. In some embodiments the air release tube 80 is a simple tube without a valve.

Figure 5:
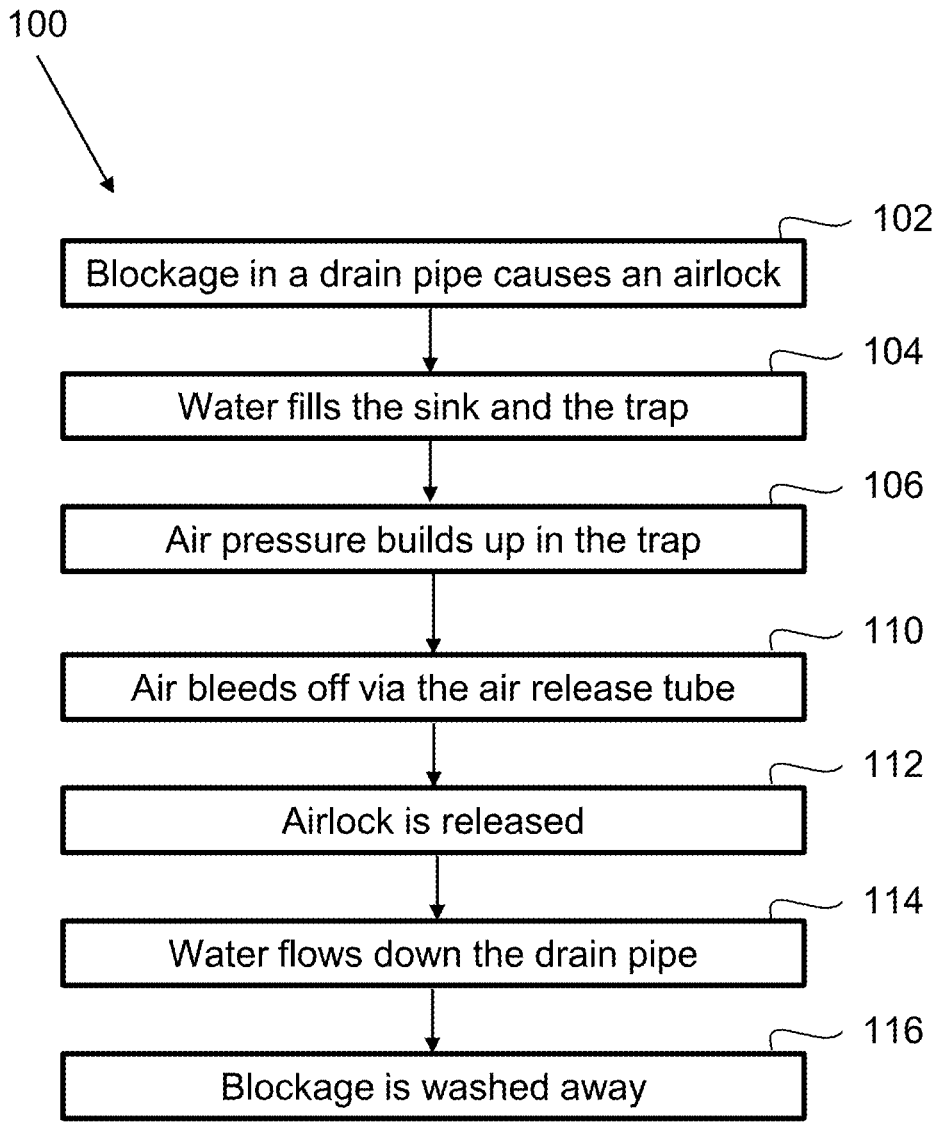
FIG. 5: Flow diagram of a method of use of an airlock treatment system, in accordance with some embodiments of the current invention.

Reference is made to FIG. 5, which is a flow diagram of use of an airlock treatment system, in accordance with an embodiment of the current invention. For example, in method 100, a blockage in the drain pipe may cause 102 an airlock preventing water from entering the drain pipe from the trap, resulting in water filling 104 the trap and/or the sink. This leads to an increase 106 in air pressure, causes to bleed off 110 trapped air through the air release tube. Optionally the release tube may include a one-way valve and the air pressure may open the one-way air release valve. The airlock is prevented or released 112, and water flows 114 freely down the vent tube to wash away 116 the blockage.

Figure 6:
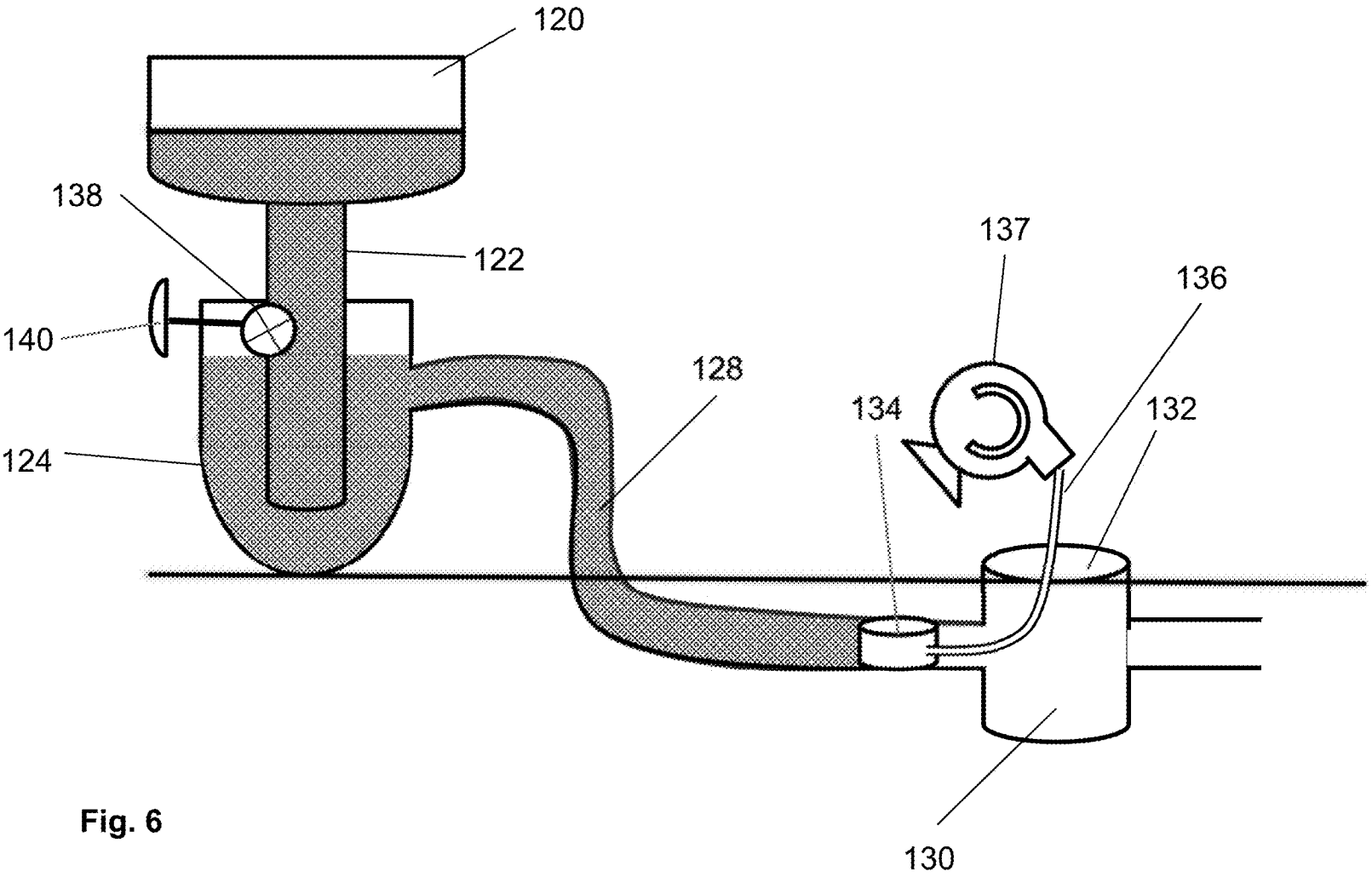
FIG. 6: Schematic illustration of an airlock prevention system, in accordance with some embodiments of the current invention.

Reference is made to FIG. 6, which is a schematic illustration of an airlock prevention system, in accordance with an embodiment of the current invention. For example, a sanitation system with normal function in which sink 120 is connected to drain tube 122 leading to trap 124. In some embodiments, an air release vent may vent air from trap 124 into a higher portion of the drain tube 122. For example, the vent may include a one way valve. Trap 124 contains water, and is connected by drain pipe 128 to clean out fixture 130 with a sealable access hole 132. Drain pipe 128 includes an inflatable pipe plug 134 which may be used to deliberately block drain pipe 128. Inflatable pipe plug 134 may be inflated and/or deflated by a user. Optionally, inflatable pipe plug 134 may have a filling tube 136 that is accessible at one or more convenient locations. For example, the filling tube 136 may be available at a clean out access point and/or may snake through a drain tube and/or be accessed above the trap. Optionally the filling tube 136 is connected to a pump 137. Controls for the pump 137 (e.g., for filling the plug 134) may be located in any location, for example near the sink and/or in a cabinet and/or near the trap 124.

In some embodiments, the back pressure may prevent a valve from opening. Optionally, a bleed valve 138 may be included in the system. For example, bleed valve 138 may be positioned above the trap. Alternatively, or additionally, bleed valve 138 may open and close. For example, bleed valve 138 may include knob 140 for opening and closing the valve by the user. Bleed valve 138 may be included along with and/or in place of the one-way air release vent.

Figure 7:
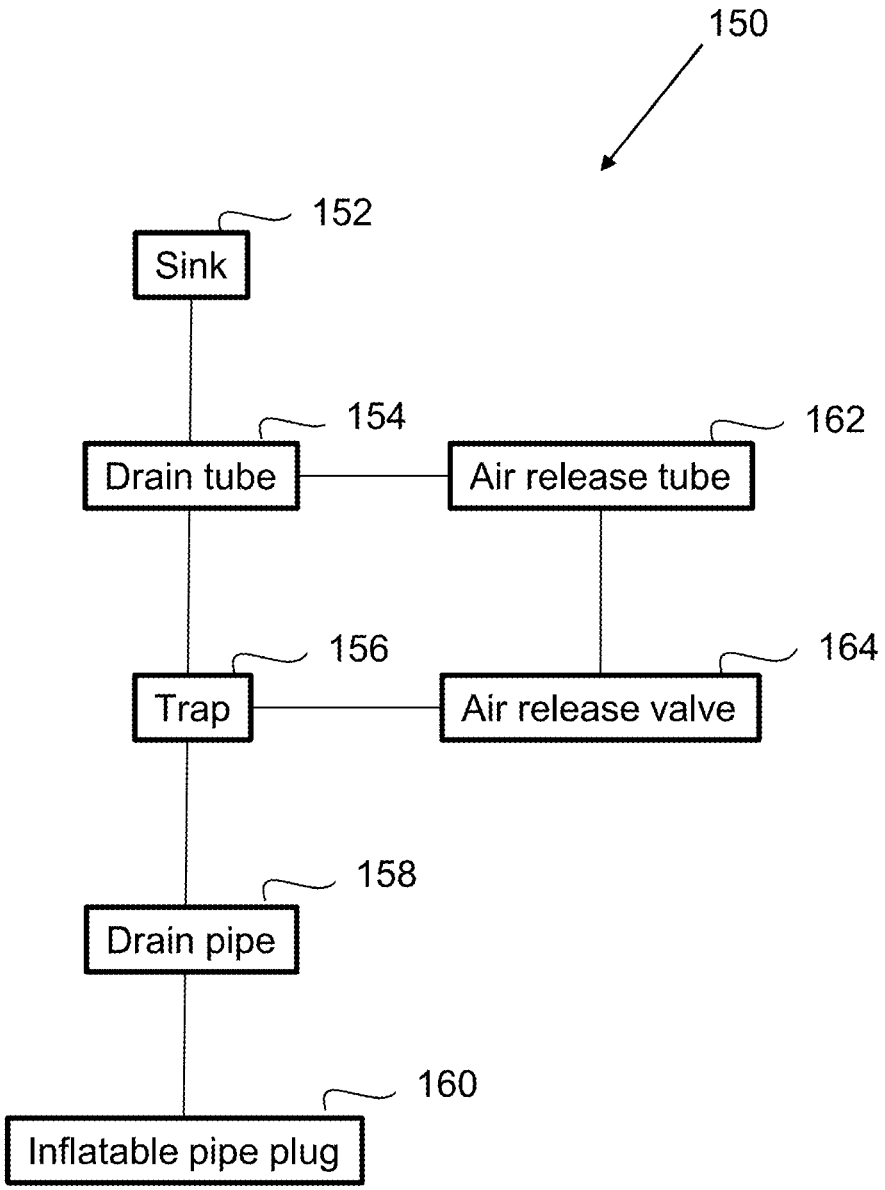
FIG. 7: Block diagram of an airlock prevention system, in accordance with some embodiments of the current invention.

Reference is made to FIG. 7, which is a block diagram of an airlock prevention system, in accordance with an embodiment of the current invention. For example, a drainage system 150 may include sink 152 connected by drain tube 154 to trap 156 connected to drain pipe 158. Trap 156 may include a one-way air release valve 164 connected by an air release tube 162 to drain tube 154. Drain pipe 154 may include inflatable pipe plug 160 which may be inflated to block drain pipe 154. Drain pipe 154 may be blocked by inflating inflatable pipe plug 160 and filled with cleaning fluid, removing accumulated dirt. Deflating inflatable pipe plug 160 facilitate passage of the cleaning fluid and/or waste water. Airlock is prevented by bleeding off the air through the air release valve 164 and air release tube 162 back into drain tube 154 and/or sink 152. In some embodiments the air release tube 162 is a simple tube without a valve.

Figure 8:
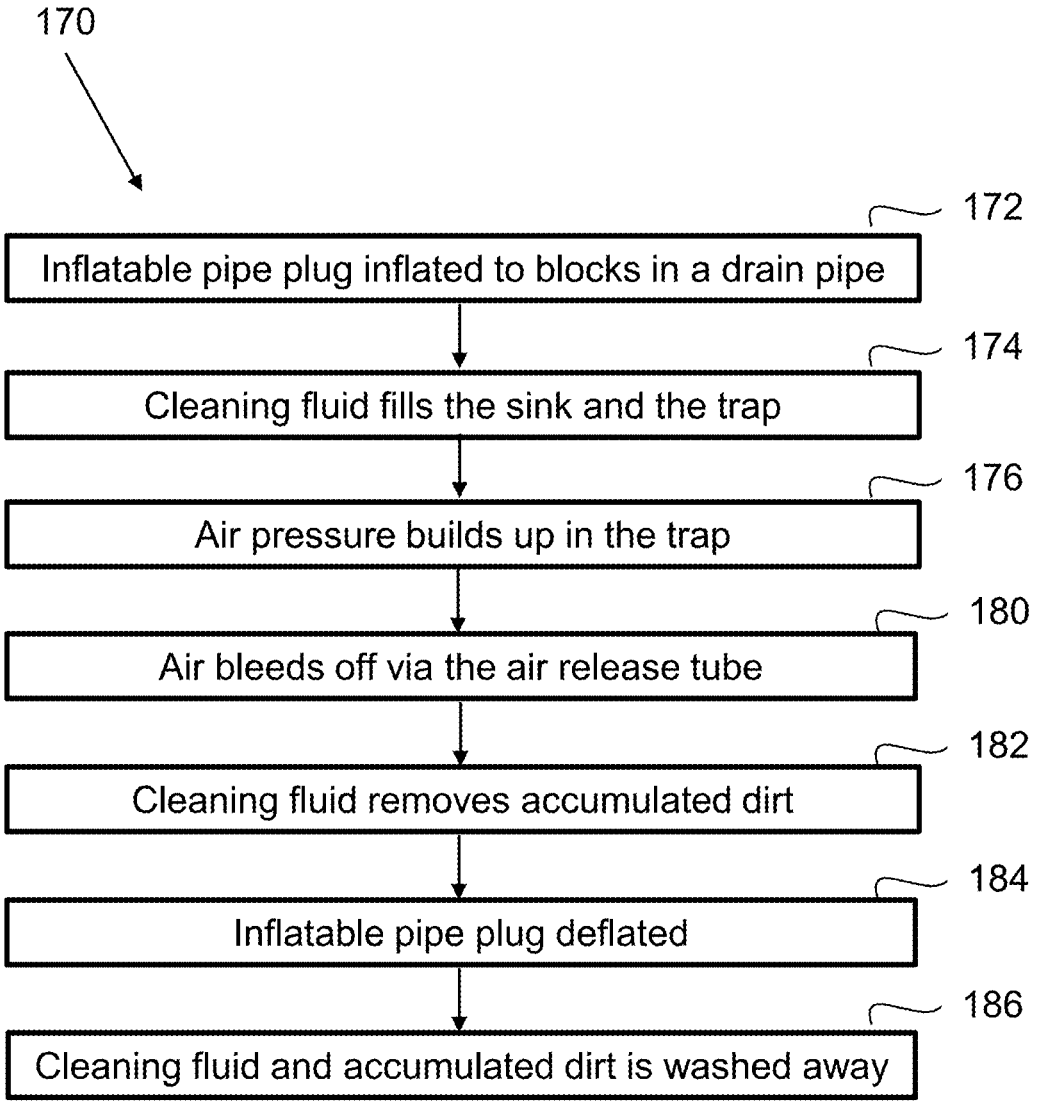
FIG. 8: Flow diagram a method of use of an airlock treatment system, in accordance with some embodiments of the current invention.

Reference is made to FIG. 8, which is a flow diagram of use of an airlock treatment system, in accordance with an embodiment of the current invention. For example, in method 170, the user may inflate 172 the inflatable pipe plug, blocking the drain pipe. The sink, drain tube, trap and drain pipe are filled 174 with a cleaning fluid. Air pressure builds up 176 in the trap. Air may be bled off 180 through an air release tube to prevent an airlock from forming as the system is filled with cleaning fluid (e.g., bleach, soap, acid, etc.). The cleaning fluid is then allowed to sit in the system for a period of time (e.g., several minutes or hours) to remove 182 accumulated dirt. After a period of time, the user may deflate 184 the inflatable pipe plug, opening the drain pipe and allowing the cleaning fluid and removed dirt to flow out 186 of the system, thereby cleaning the system and preventing the formation of a blockage, bad odors, and possible airlock. Optionally the release tube may include a one-way valve and the air pressure may open the one-way air release valve.

Figure 9:
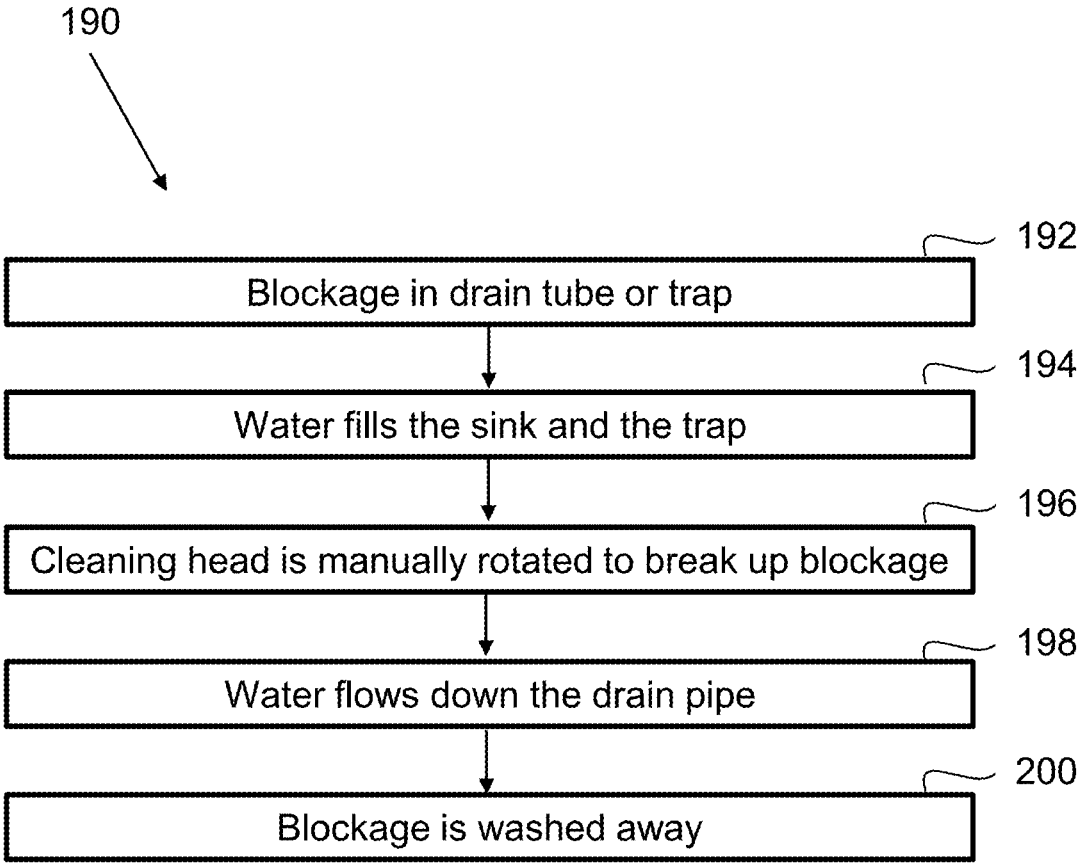
FIG. 9: Schematic illustration of a method for use of a blockage clearing system, in accordance with some embodiments of the current invention.

Reference is made to FIG. 9, which is a flow diagram of a method for use of a blockage clearing system, in accordance with an embodiment of the current invention. For example, in method 190, a blockage forms 192 in the drain tube or trap, causing water to back up and fill 194 the sink and/or the trap. The cleaning head is manually rotated 196 to break up the blockage. Water flows 198 down the drain pipe and washes 200 away the blockage.

Figure 10:
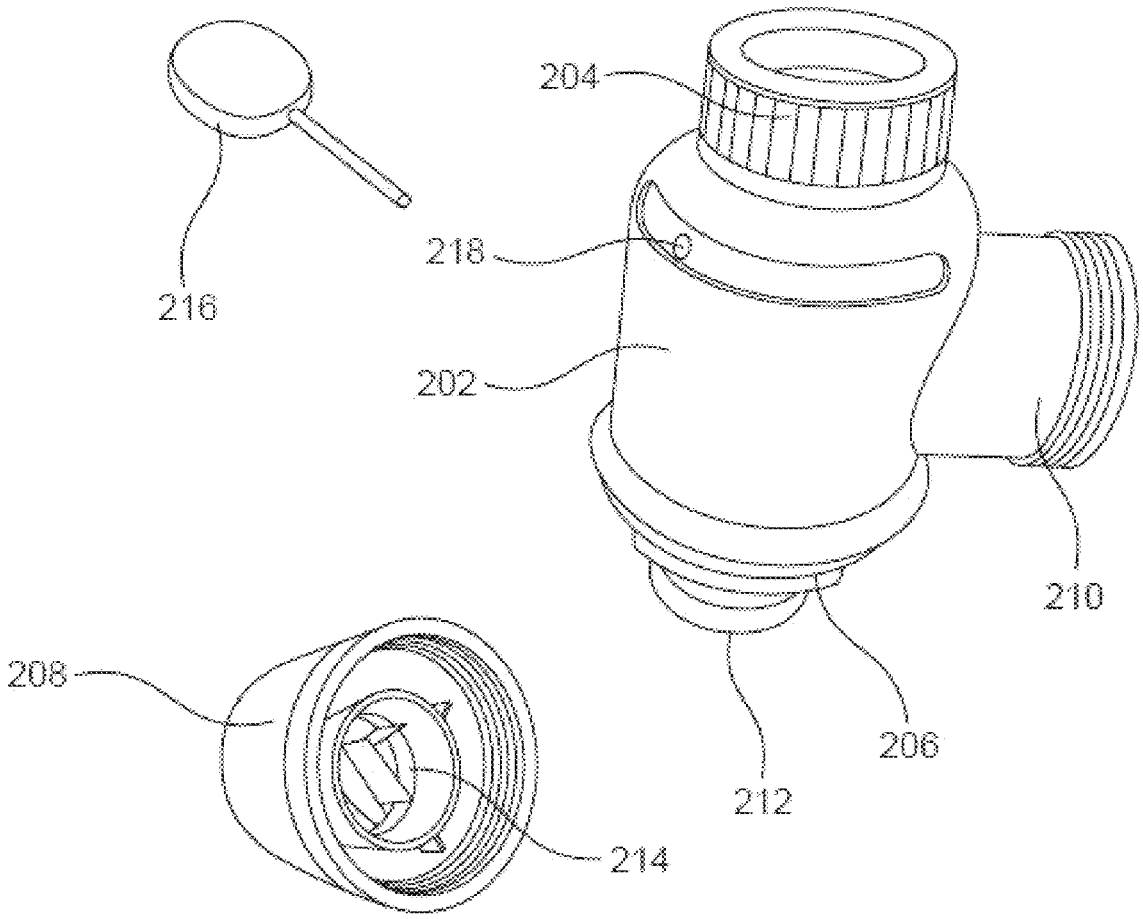
FIG. 10: Schematic illustration of an exploded view of a blockage clearing system, in accordance with some embodiments of the current invention.

Reference is made to FIG. 10, which is an exploded view of a blockage clearing system, in accordance with an embodiment of the current invention. For example, siphon may include a connector 204 to the drain tube for entrance of water, a siphon body 202, a trap cup connector 206, a trap cup 208 and a water outlet 210 for exit of water. The siphon may include a rotating tube 212. Rotating tube 212 may connect to a cleaning head 214. The cleaning head 214 may be located at the base of the rotating tube 212, drain tube (not shown), or trap cup 208. The rotating tube 212 may be rotated by a handle 216. For example, handle 216 may be connected to the rotating tube 212 through port 218. The port 218 may include a means of preventing exit of water through the port, e.g., a washer.

In some embodiments, sliding the handle horizontally and/or circumferentially may rotate the rotating tube and/or thereby the cleaning head and/or blades thereby breaking up material stuck to the inner walls of the trap cup and/or the inner walls of the drain tube. Note that the rotating tube and/or drainage tube may include a bypass port, such that rotating the rotating tube may open and/or close the bypass port (for example, as described in U.S. Pat. No. 11,732,458 to the present inventor e.g., FIGS. 2A-2C therein).

Figure 11A:
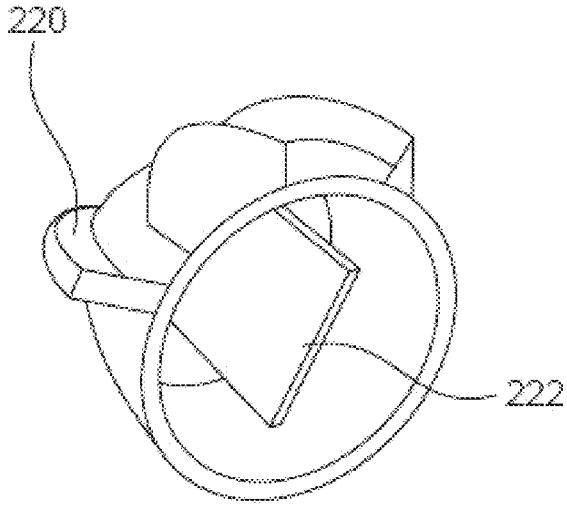
FIGS. 11A-11B: Schematic illustrations of a cleaning head, in accordance with some embodiments of the current invention.
Figure 11B:
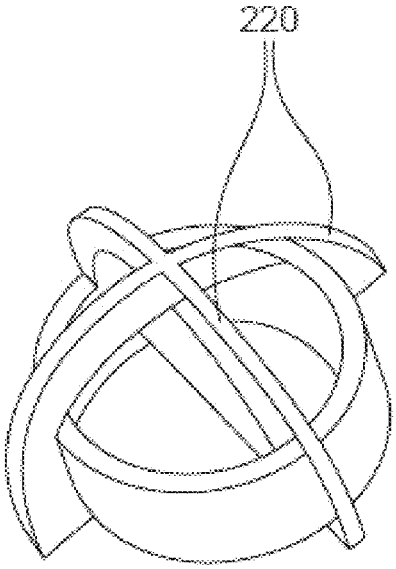

Reference is made to FIGS. 11A-B, which are two views of a schematic illustration of a cleaning head, in accordance with an embodiment of the current invention. For example, the cleaning head may include one or more external blades 220, one or more internal blades 222, or both. Optionally, the blades are fixed to the cleaning head and rotating the cleaning head rotates the blades rotatable. The internal blades 222 may be positioned within the drain tube and/or rotating tube. Optionally, internal blades 222 may be rotated within the drain tube and/or rotating tube, thereby cleaning the drain tube and/or rotating tube. The external blades 220 may project outward, into the trap. Optionally, external blades 220 may be positioned within the trap. Optionally, external blades 220 may be rotated within the trap, thereby cleaning the trap. The internal blades 222 and/or external blades 220 may be straight and/or angled and/or curved.

Figure 12:
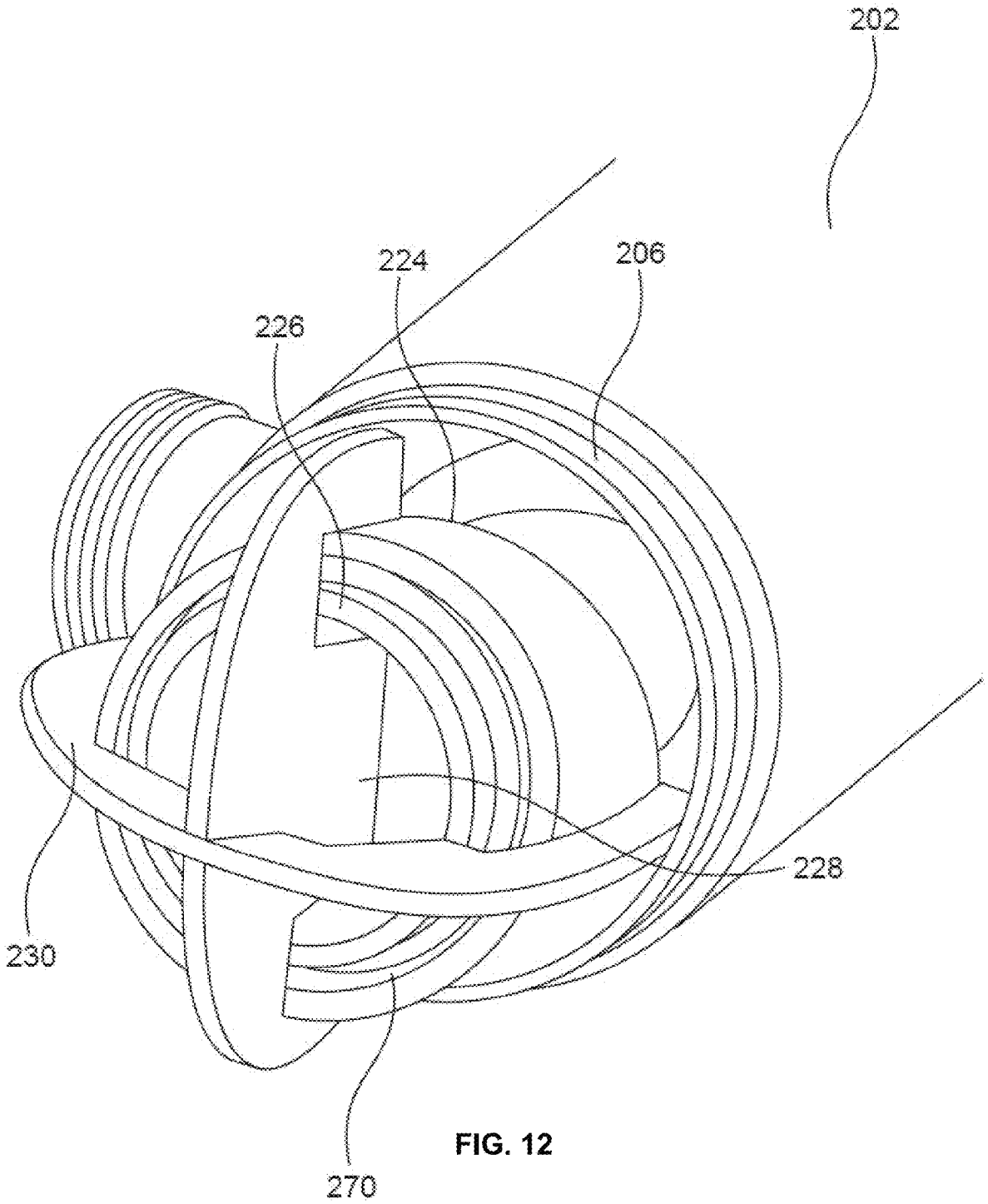
FIG. 12: Schematic illustration of a cleaning head attached to rotating tube (without the trap cup), in accordance with some embodiments of the current invention.

Reference is made to FIG. 12, which is a schematic illustration of a view of a cleaning head attached to rotating tube 270, in accordance with an embodiment of the current invention. For example, the siphon may include a siphon body 202 a having a trap cup connector 206 (in the figure the trap cup has been removed). A rotatable tube 270 is attached to a cleaning head 224 at its base. The cleaning head 224 includes blades projecting into the drain tube 226 (internal blades 228), into the trap (external blades 230), or both. Optionally, rotating the rotating tube 270 rotates cleaning head 224 and blades 228, 230, thereby cleaning the drain tube 226, the trap, and/or the rotating tube 270. Alternatively, or additionally, the cleaning head 224 may be rotated automatically (e.g., by the force of the fluid flow) and/or manually (e.g., by the user). Rotation of the blades 228, 230 on the cleaning head 224 may prevent and/or break up blockage of the drain tube and/or trap.

Figure 13A:
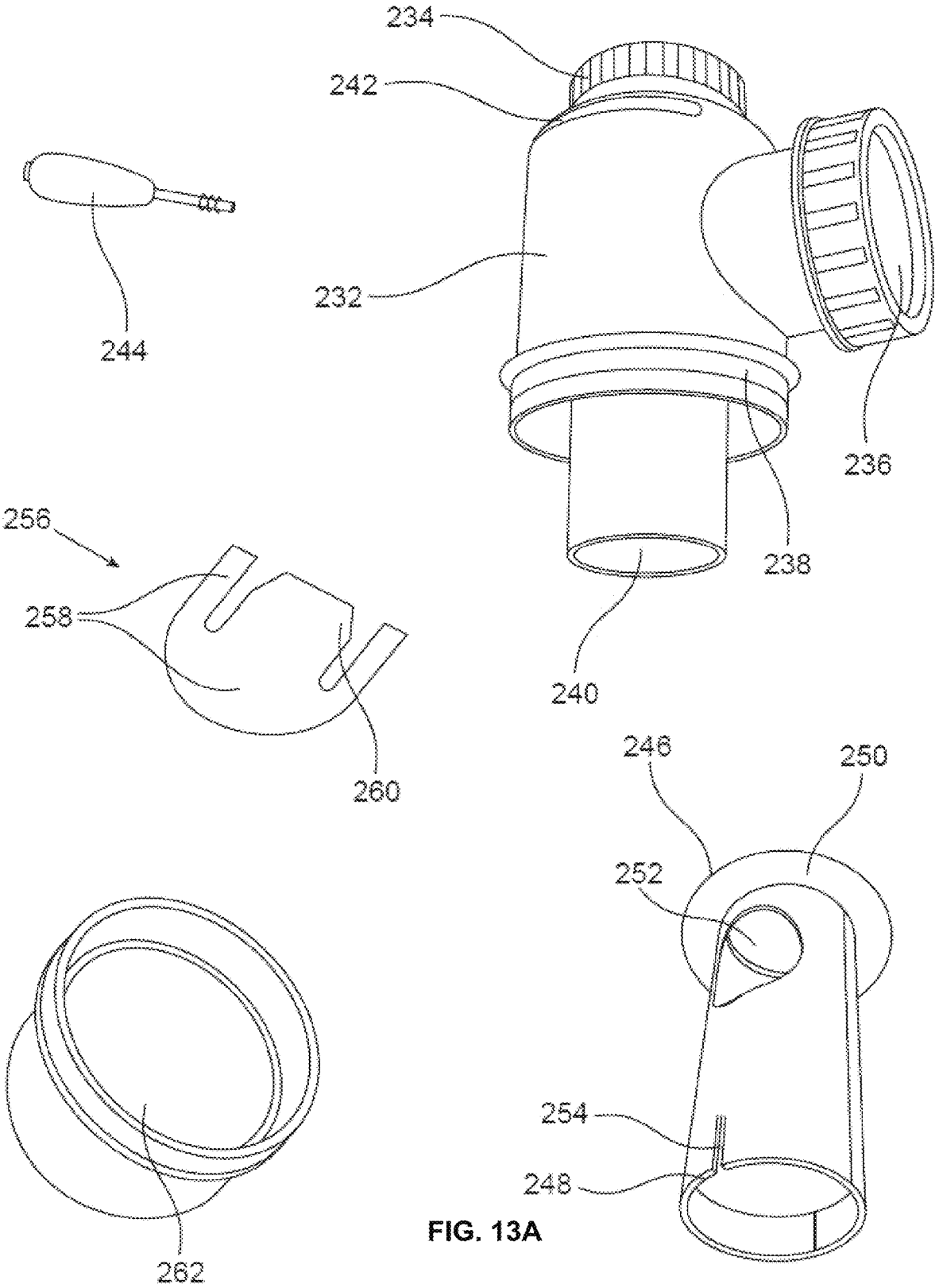
FIGS. 13A-C: An exploded view of an exemplary cleaning head and rotating tube, and two partially assembled views of an exemplary cleaning head and rotating tube, in accordance with some embodiments of the current invention.
Figure 13B:
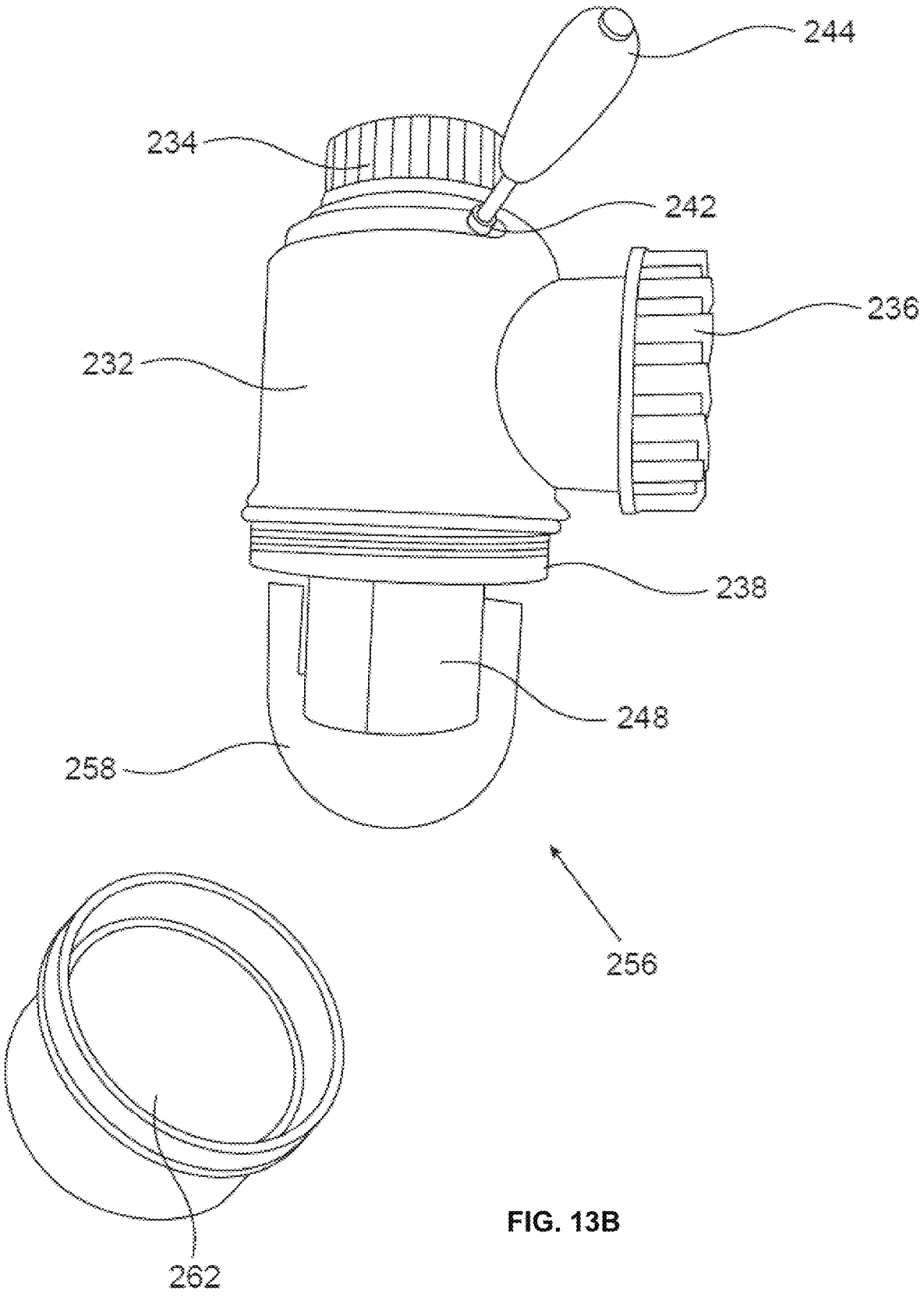
Figure 13C:
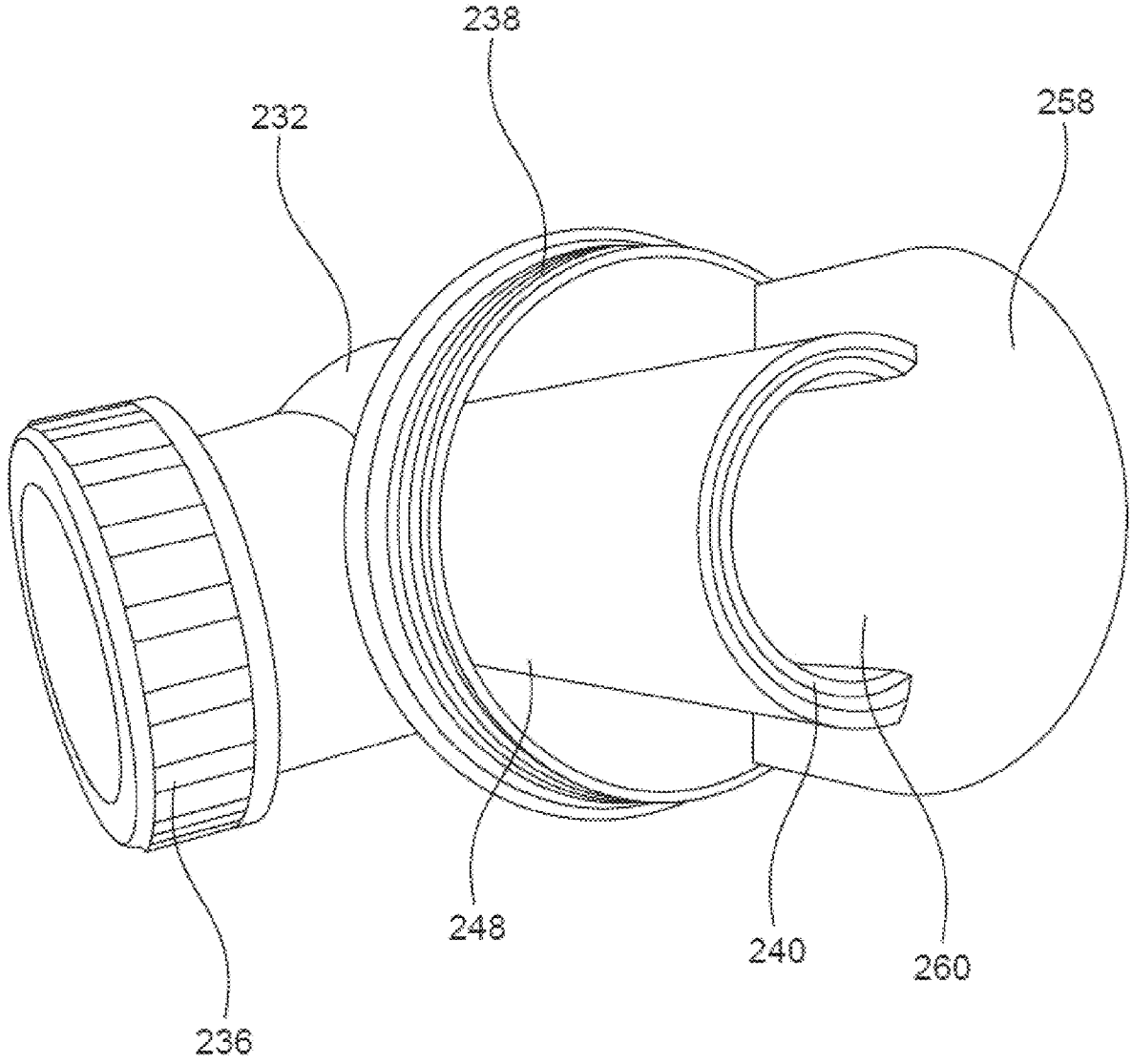

Reference is made to FIGS. 13A-C, which are an exploded view of an exemplary cleaning head and rotating tube, and two partially assembled views of an exemplary cleaning head and rotating tube, in accordance with an embodiment of the current invention. For example, the siphon may include a trap body 232 with a drain tube connector 234, a water outlet connector 236, a trap cup connector 238, and a fixed inner tube 240. Optionally, trap body 232 may include a handle port 242 for a handle 244. Handle 244 may connect through handle port 242 to a handle connector 246 of a rotating tube 248. Optionally, a gasket 250 may seal the rotating body of the siphon against leakage of water and/or air. Optionally, rotating tube 248 may include one or more trap bypasses 252. Optionally, rotating tube 248 may not include a trap bypass. Optionally, rotating tube 248 may include a blade connector 254, e.g., for connection to a cleaning head and/or external blade and/or internal blade. Optionally, cleaning head 256, may include one or more external blades 258, and/or one or more internal blades 260. Optionally, the internal blade and external blades may be connected and/or co-molded. Optionally, cleaning head 256 may be contained within a trap cup 262.

According to some embodiments, two or more co-molded internal blade and external blades may be reversibly connected together. Optionally, two or more co-molded internal blade and external blades may be connected by clipping together, adhering, and/or fixing mechanically to each other.

Optionally, two or more co-molded internal blade and external blades may provide a cleaning head, or part thereof.

Figure 14:
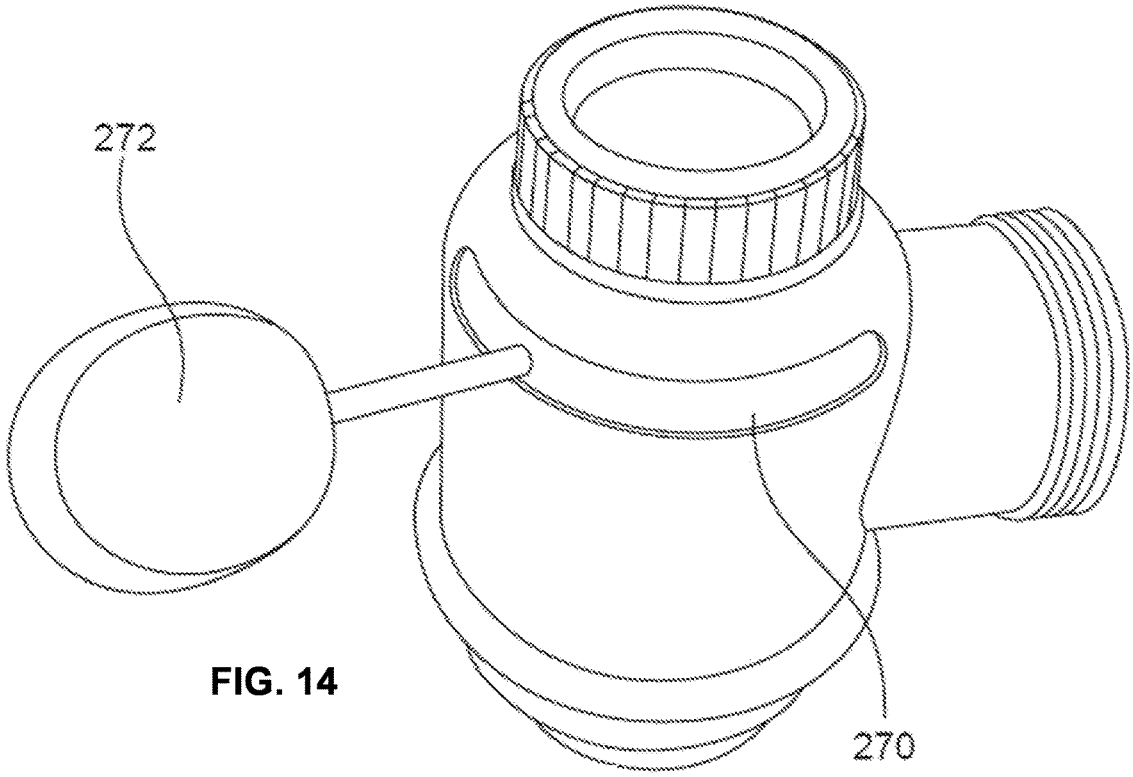
FIG. 14: Schematic illustration of an assembled view of a trap body, in accordance with some embodiments of the current invention.
Figure 15:
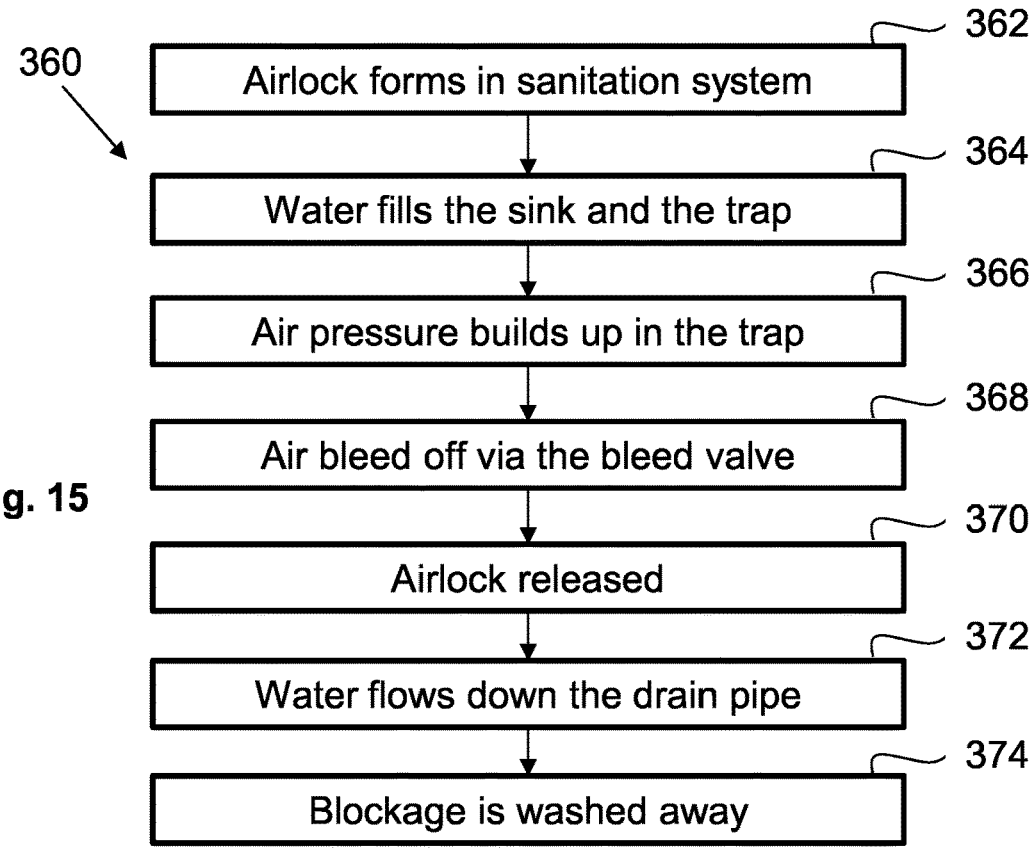
FIG. 15: Flow chart of a method of releasing an airlock in a sanitation system, in accordance with some embodiments of the current invention.

Reference is made to FIG. 14, which is a schematic illustration of an assembled trap body, in accordance with an embodiment of the current invention. For example, the siphon may include a rotating tube 270. Optionally, the siphon may include a handle 272 to rotate rotating tube 270 and/or a cleaning head (not shown), or both. In some embodiments, sliding handle 272 horizontally and/or circumferentially may rotate rotating tube 270 and/or thereby the cleaning head and/or blades thereby breaking up material stuck to the inner walls of the trap cup and/or the inner walls of the drain tube. Optionally, the rotating tube and/or drainage tube may include a bypass port. such that rotating the rotating tube may open and/or close the bypass port (for example, as described in U.S. Pat. No. 11,732,458 to the present inventor e.g., FIGS. 2A-2C therein).

Reference is made to FIG. 18, which is a flow chart of a method of releasing an airlock in a sanitation system, in accordance with some embodiments of the current invention. For example, in method 360, a blockage causes an airlock 362 in a sanitation system, resulting in water filling 364 the sink, drain tube, and/or trap. Air pressure builds up 366 in the trap. Air is bled off 368 via a bleed valve located on the upper portion of the trap body of the siphon, thereby releasing 370 the airlock and facilitating waste water flow 372 through the system to wash away 374 the blockage.

Figure 16:
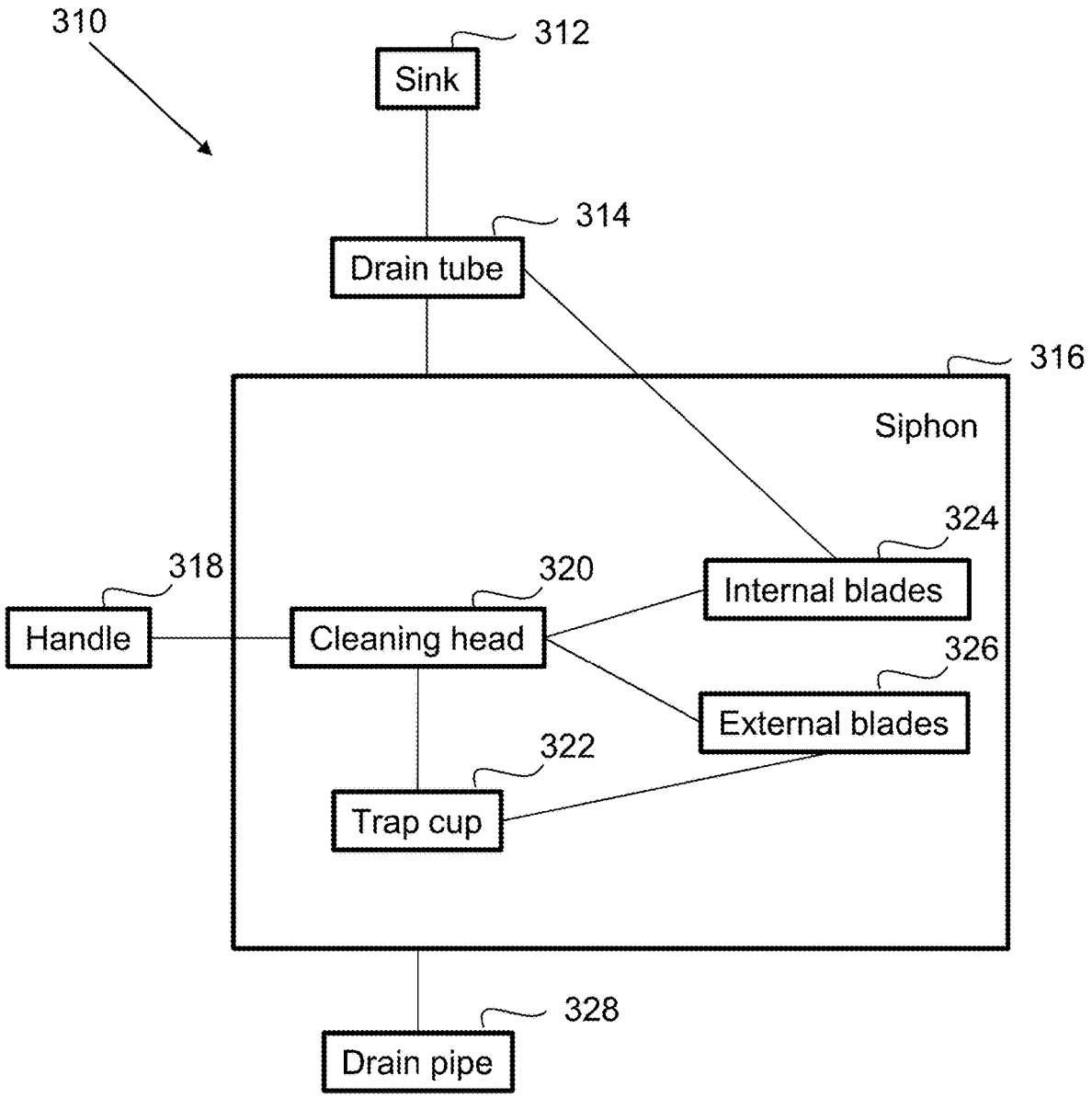
FIGS. 16-17: Block diagrams of blockage clearing systems, in accordance with some embodiments of the current invention.

Reference is made to FIG. 16 is a block diagram of a blockage clearing system, in accordance with an embodiment of the current invention. For example, in blockage clearing system 310, sink 312 is connected through a drain tube 314 to a siphon 316. The siphon 316 may optionally include a rotating tube (not shown). A cleaning head 320 including internal blades 324, external blades 326, or both is optionally rotatably connected to the trap cup 322. A crank handle 318 optionally projects out of the trap cup 322. Moving (e.g., rotating) crank handle 318 optionally rotates the cleaning head 320 and/or cleans the drain tube 314 and/or trap cup 322. Rotation of the cleaning head 320 may prevent and/or break up blockages of the drain tube 314 and/or trap cup 322. The siphon includes a water outlet connected to a drain pipe 328 for water drainage.

Figure 17:
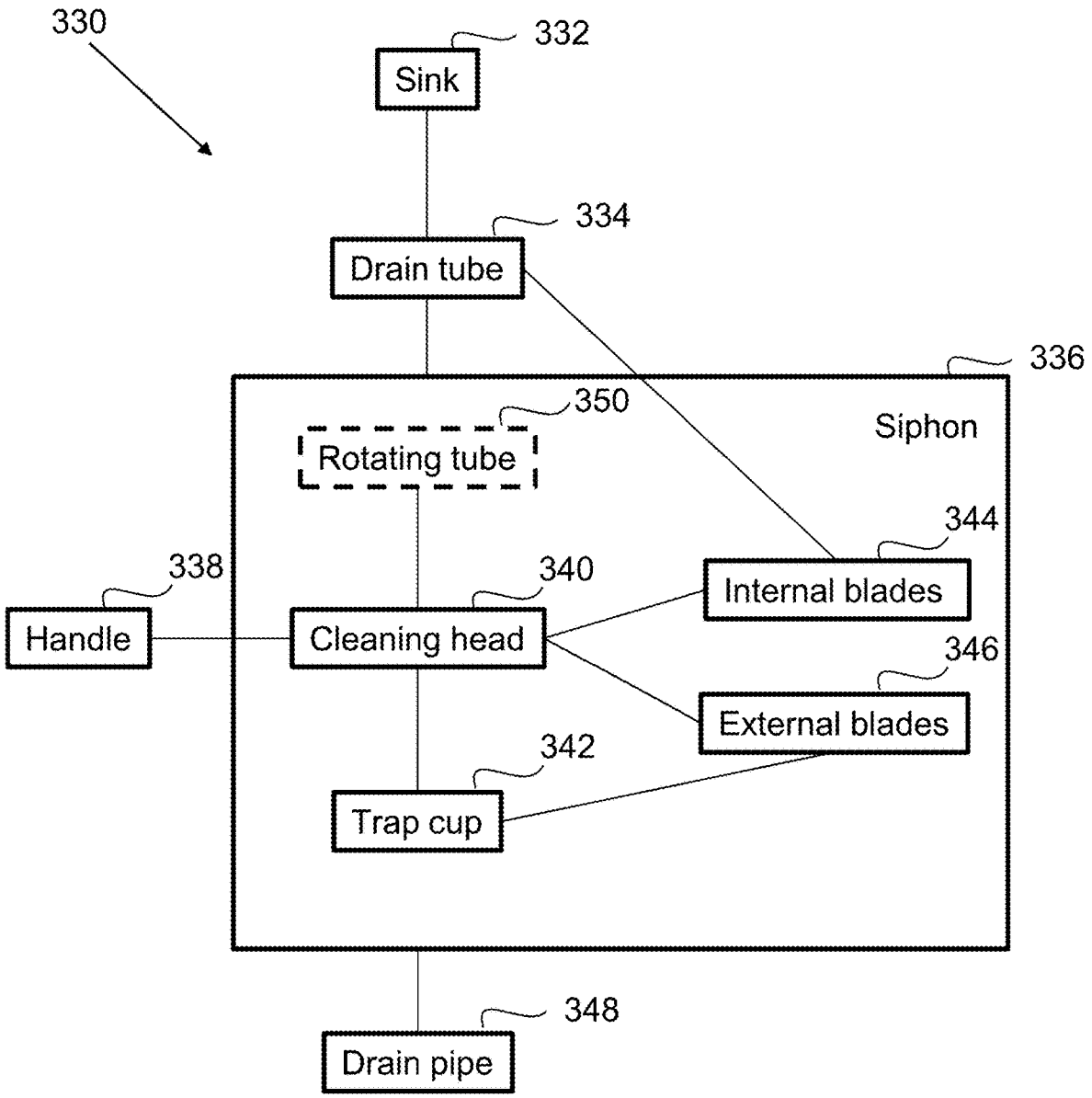

Reference is made to FIG. 17, which is a block diagram of a blockage clearing system, in accordance with an embodiments of the current invention. For example, in blockage clearing system 330, sink 332 is connected through a drain tube 334 to a siphon 336. The siphon 336 may optionally include a rotating tube 350. A cleaning head 340 including internal blades 344, external blades 346, or both is optionally rotatably connected to the trap cup 322. Crank handle 338 optionally projects out of the trap cup 342. Moving (e.g., rotating) the crank handle 338 optionally rotates the cleaning head 340 and/or cleans the drain tube 314 and/or trap cup 342. Rotation of the cleaning head 340 may prevent and/or break up blockages of the drain tube 334 and/or trap cup 342. The siphon includes a water outlet connected to a drain pipe 348 for water drainage.

According to some embodiments, the bleed valve may be located on an upper portion of a siphon. Optionally, a bleed valve may be located at one or more locations along the length of the drain pipe. Optionally, the system may include one or more bleed valves. Optionally, the bleed valve may be sealed against the exit of waste water. Optionally, the bleed valve may be opened and/or closed manually. Optionally, the bleed valve may comprise a rotatable knob and screw within a bleed valve port. Optionally, the bleed valve and knob may be a simple hole and a plug (e.g., a removable screw that blocks the hole).

These embodiments are provided by way of example and are in no means intended to be limiting the scope of the invention.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

General

It is expected that during the life of a patent maturing from this application many relevant building technologies, artificial intelligence methodologies, computer user interfaces, image capture devices will be developed and the scope of the terms for design elements, analysis routines, user devices is intended to include all such new technologies a priori.

Unless otherwise defined, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

As used herein the term "about" refers to ±10%

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A system for breaking up a blockage in a sanitation system, the sanitation system including a drain tube connected to a drain pipe via a trap cup comprising:

a cleaning head located in the trap cup;

the cleaning head including an external blade inside the trap cup, a handle projecting out from said sanitation system configured for manually rotating said cleaning head, thereby moving said external blade inside said trap cup preventing or breaking up the blockage of the trap cup, and an internal blade inside the drain tube, wherein rotating said cleaning head moves said internal blade inside said drain tube preventing or breaking up the blockage of the drain tube.

2. The system according to claim 1, further comprising a rotating tube concentric to the drain tube and wherein said handle is connected to said rotating tube.

3. The system according to claim 2, wherein a base of the rotating tube is mounted to the cleaning head.

4. The system according to claim 3, wherein the rotating tube is configured to be manually rotated by sliding the handle connected through a port of the sanitation system horizontally and radially with respect to the rotating tube.

5. The system according to claim 2, wherein the rotating tube includes a bypass configured to facilitate exit of waste water directly from said drain tube to said drain pipe without passing through the trap cup.

6. A method for breaking up a blockage in a sanitation system, the sanitation system including a drain tube connected to a drain pipe via a trap cup, the method comprising:

manually manipulating a handle accessible from outside said sanitation system;

rotating a cleaning head as a result of said manually manipulating, wherein the cleaning head includes an external blade located within the trap cup and wherein the cleaning head includes an internal blade located in the drain tube; and breaking up of the blockage of the trap cup or the drain tube via said rotating.

7. The method according to claim 6, further comprising:

rotating a rotating tube concentric to the drain tube as a result of said manually manipulating and wherein said handle is connected to said rotating tube and wherein a base of the rotating tube is mounted to the cleaning head.

8. The method according to claim 7, wherein said manually manipulating includes sliding the handle horizontally and circumferentially with respect to the rotating tube, wherein the handle is connected through a port of the sanitation system horizontally and radially with respect to the rotating tube.

9. The method according to claim 6, further comprising:

opening a bypass configured to facilitate exit of waste water directly from said drain tube to the drain pipe without passing through the trap cup.

10. The method according to claim 9, wherein said opening is a result of said rotating.

11. The method of claim 10, wherein said rotating aligns a hole in a rotating tube with a side hole in the drain tube facilitating said opening.

12. The method according to claim 6, further comprising washing away the broken-up blockage.

* * * * *